United States Patent [19]

Pechner

[11] 4,200,149

[45] Apr. 29, 1980

[54] HEAT EXCHANGER WITH FLUID TURBULATOR

[76] Inventor: Murray Pechner, 2309 W. 144th St., Gardena, Calif. 90249

[21] Appl. No.: 747,620

[22] Filed: Dec. 6, 1976

[51] Int. Cl.[2] ..... F28F 1/40; F28F 13/12

[52] U.S. Cl. ..... 165/109; 123/41.33; 138/38; 138/42

[58] Field of Search ..... 138/38, 42; 122/367 PF, 122/501; 165/109, 109 T, 151, 181, 182, 174; 184/104 B; 123/196 AB, 41.33, 41.42

[56] References Cited

U.S. PATENT DOCUMENTS

| | | | |
|---|---|---|---|
| 1,739,672 | 12/1929 | Higgins | 165/151 |
| 1,948,929 | 2/1934 | MacPherson | 123/41.33 |
| 2,161,887 | 6/1939 | Ramsaur | 138/38 |
| 2,359,288 | 10/1944 | Brinen | 138/38 |
| 2,488,615 | 11/1949 | Arnold | 138/38 |
| 2,803,440 | 8/1957 | Simpelaar | 165/179 |
| 2,804,286 | 8/1957 | Pintarelli | 165/182 |
| 3,438,433 | 4/1969 | Gunter | 165/151 |
| 3,769,959 | 11/1973 | Parker | 138/38 |
| 3,898,797 | 8/1975 | Wood | 138/38 |

FOREIGN PATENT DOCUMENTS

| | | | |
|---|---|---|---|
| 156781 | 1/1952 | Australia | 165/151 |
| 954282 | 9/1974 | Canada | 165/151 |
| 1816642 | 8/1969 | Fed. Rep. of Germany | 123/196 AB |
| 2449145 | 4/1976 | Fed. Rep. of Germany | 165/151 |
| 1250888 | 12/1960 | France | 165/174 |
| 1017246 | 1/1966 | United Kingdom | 165/151 |

*Primary Examiner*—Sheldon Richter
*Attorney, Agent, or Firm*—Lewis B. Sternfels

[57] ABSTRACT

A serpentine or parallely formed conduit is fixed within a support and is further joined on its exterior surfaces by a plurality of fins. The fins have a plurality of louvered cups which define openings in the fins so that air or other heat transfer medium will pass through the fins and be turbulated around the conduits for improved heat transfer. Within the conduits are strips having similar louvered cups and openings therein and these also enhance turbulance of the fluid passing through the conduits to augment heat transfer.

8 Claims, 6 Drawing Figures

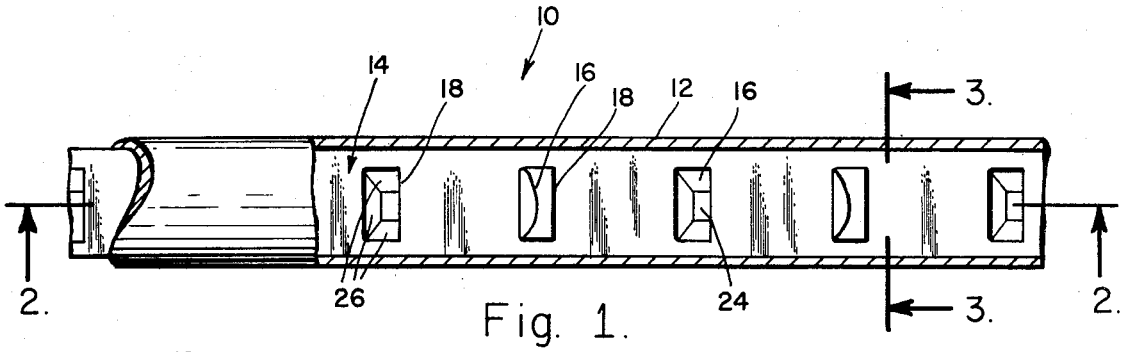
Fig. 1.
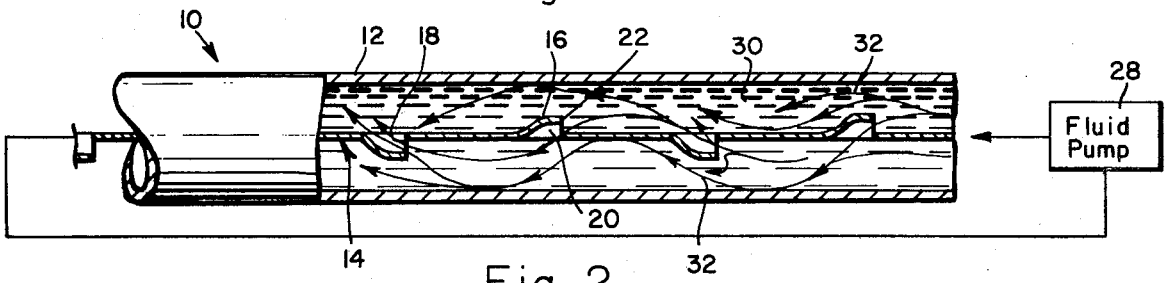
Fig. 2.
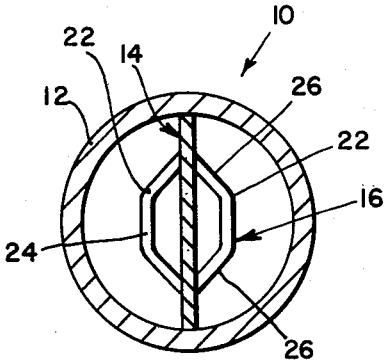
Fig. 4.
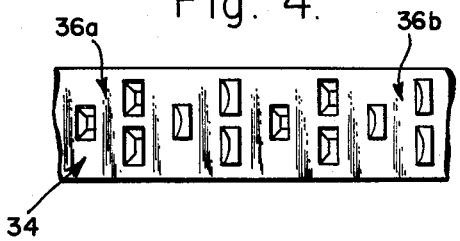
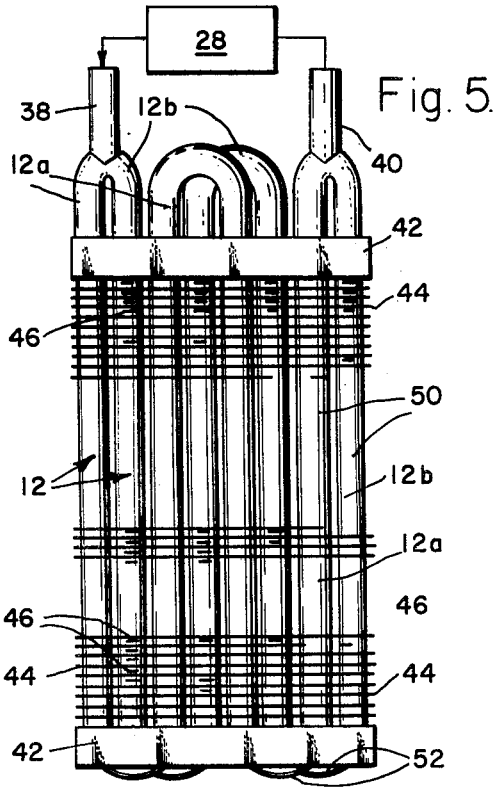
Fig. 5.
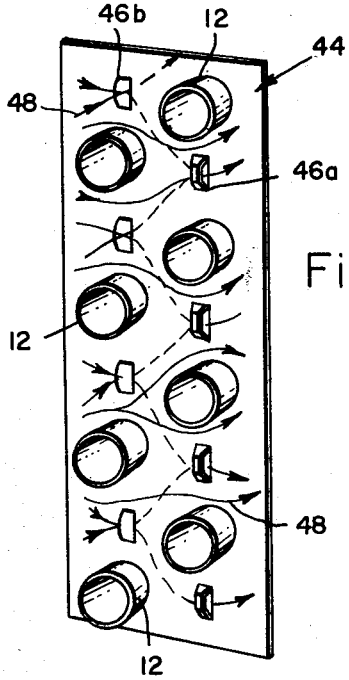
Fig. 6.

HEAT EXCHANGER WITH FLUID TURBULATOR

BACKGROUND OF THE INVENTION

1. Field of the Invention

The present invention relates to a heat exchanger and, more particularly, to such a heat exchanger having means for enhancing heat transfer of media associated therewith.

2. Description of the Prior Art

It has been long known, for example, in oil colors and transmission heat exchangers for internal combustion engines, that oil and similar fluids can be made to transfer greater amounts of heat therein by providing turbulators within the oil conduits. This increased turbulance permits the greater amount of oil to contact the inner surfaces of the conduit through which it flows for further transfer of the heat of the surrounding atmosphere. Examples of prior art include cross plate fins as well as sunburst type fins surrounding an inner core, both within the conduit. Both increase the effective surface area for transfer of heat from the oil to the conduit but are deficient, for example, in cost or efficiency of heat removal.

Other types of heat exchanger means are exemplified in U.S. Pat. Nos. 2,359,288; 2,677,394; 2,826,220; 3,769,959; 3,783,938 and 3,981,356. In these patents, the devices require attachment or multiple intimate contact with the walls of the conduit in order to provide adequate support not only for the turbulators as a whole but also for the elements projecting therefrom, whether permanently attached to the conduit walls or not. In one case, U.S. Pat. No. 3,981,356, the turbulator is a mesh in which the specific turbulation producing surfaces were merely connected to adjacent portions. Such constructions are relatively expensive to fabricate, when mass produced, and may, in some cases, provide for a high degree of impediment to fluid flow.

SUMMARY OF THE INVENTION

The present invention avoids or overcomes these and other deficiencies, drawbacks or problems by providing for a simply manufactured turbulator for the interior and the exterior of the conduits in which maximum turbulance with minimum impediment to fluid flow is provided. The interior turbulator may be easily removed. These features are obtained by a plurality of louvered cups placed at openings in fins surrounding the conduits and in strips placed within the conduits. The combination of the cups and openings cause the fluid or other heat transfer medium to move with turbulance towards the conduit and fin surfaces but with minimum impediment to flow. Furthermore, such cups and openings may be simultaneously formed by simple progressive die stamping operations. It is to be understood that the fluids for either or both the interior and the exterior of the conduits may be liquid or gas.

It is, therefore, an object of the present invention to provide for a turbulator for improved heat transfer of flowing fluids, whether liquid or gas.

Another object is to provide for a simply manufacturable turbulator.

Another object of the invention is to provide for such a turbulator which presents minimum impediment to fluid flow, while providing maximum turbulation.

Another object of the present invention is to provide for a removable fluid turbulator.

Other aims and objects as well as a more complete understanding of the present invention will appear from the following explanation of exemplary embodiments and the accompanying drawings thereof.

BRIEF DESCRIPTION OF THE DRAWINGS

FIG. 1 depicts a portion of a fluid conduit with a turbulator placed therein;

FIG. 2 is a view taken of the conduit and turbulator of FIG. 1 taken along lines 2—2 thereof with the addition of the fluid moving means and type of turbulance and fluid flow obtained thereby;

FIG. 3 is a view of the embodiment of FIG. 1 taken along lines 3—3 thereof;

FIG. 4 is a modification of the fluid turbulator illustrated in FIG. 1;

FIG. 5 is a view of a complete heat exchanger incorporating conduits and fluid turbulators therein such as shown in FIG. 1, and fins therearound; and FIG. 6 is a view of one of the fins and a portion of several of the conduits further illustrating flow of heat transfer media.

DESCRIPTION OF THE PREFERRED EMBODIMENTS

Accordingly, with respect to FIG. 1, a portion 10 of a heat transfer apparatus comprises a conduit 12 in which a strip 14 is placed. Strip 14 has a generally planar cross section with louvered cups 16 displaced therefrom such as by progressive die stamping operations. As shown, such a die stamping operation forms a cut 18 in strip 14 which defines both an opening 20 in the strip as well as an edge 22 terminating the cups. While a die and stamping operation may not form the precisely shown configuration of cups 16, for convenience, the cups may be described as having a generally flat portion 24 parallel to the plane of strip 14 and three walls 26 separate from cuts 18 for securing the flat portion to the strip. The cups are designed not to extend to the walls of conduit 12.

In FIG. 2, a fluid pump 28 is shown coupled to conduit 12 for flow of a fluid 30 therethrough. It is preferable to have the fluid flow in the direction shown so that edges 22 of cups 16 face in the direction against fluid flow. With such an arrangement, arrows 32 generally illustrate the large amount of turbulance with relatively unimpeded flow of fluid 30 through conduit 12 in order to maximize contact of the fluid with the walls of the conduit and to increase heat transfer therebetween. In order to maximize such turbulance, adjacent ones of cups 16 extend alternately from either side of strip 14 but, because the cups do not contact the conduit walls, the fluid may pass over, as well as through, the cups.

When the strip is of considerable width, it may be preferable to form a plurality of cups therein as depicted in FIG. 4. Here, strip 34 has groups 36*a* and 36*b* of similar louvered cups, such as shown in FIGS. 1–3, with each group being illustrated as being three in number. Here each alternate group of three extends alternately from each side of the strip. It is, therefore, to be understood that any spacing or grouping of cups, whether singly, in series, in parallel, staggered or in combinations thereof may be utilized.

Referring to FIG. 5, a plurality of conduits 12 are placed in serpentine manner and, as is conventional, these conduits are split into two groups, 12*a* and 12*b*, each of which is in serpentine configuration extending from inlet 38 to outlet 40. Conduits 12 are secured to supports 42, as is conventional in the art and a plurality of fins 44 is secured to the conduits, also in a manner conventional in the art. Placed in each of the fins are a plurality of louvered cups 46, which are schematically shown in FIG. 5 and more fully shown in FIG. 6. As shown in FIG. 6, the louvered cups are broken into two groups with group 46*a* extending on one side of fin 44 and group 46*b* extending on the other side of plate 44. These louvered cups are formed in a manner similar to that described above with respect to FIGS. 1–4. Here, heat transfer medium, generally indicated by arrows 48 is shown traversing around and through plate 44 by means of cups 46*a* and 46*b*. The placement of these cups are such as to maximize flow of the medium not only through the plates and along the plates but in thermal contact with and around the several conduits 12. Thus, a general swirling action of heat transfer medium 48 is provided so that maximum heat transfer may be otained. In this configuration shown in FIG. 5, a strip 14 can be loosely and removeably placed in each straight length 50 of conduits 12 and is held therein by abutment against curved or equivalent return portions 52 connecting each straight length 50 of the conduits. Thus, permanent attachment of strips 14 in conduits 12 is not required. Accordingly, removal of the strips for cleaning, repair, etc. is facilitated.

It is to be understood that, while the action of cups 16 and 46 is stated to cause turbulance, it is intended that such turbulance not unduly interfere with the laminar flow of the fluid, as illustrated in FIGS. 2 and 6. The shape of cups 16 ensures this so-called non-interfering laminar but turbulant flow.

Although the invention has been described with reference to particular embodiments thereof, it should be realized that various changes and modifications may be made therein without departing from the spirit and scope of the invention.

What is claimed is:

1. A fluid turbulator for enhancing heat transfer from oil in an oil cooler of an internal combustion engine having at least one conduit which establishes a unidirectional fluid flow path for the oil from an inlet to an outlet comprising:

a generally planar strip positioned in the conduit;

means defining openings in said strip for permitting the flow of the fluid therethrough; and a plurality of louvered cups equal in number to said opening means and positioned at said opening means, and each having a leading edge extending out of the plane of said strip and a closed portion merging from said leading edge into the plane of said strip, said leading edges of all of said cups extending towards the inlet and into the path of the fluid flow and said closed portions of all of said cups extending towards the outlet and away from the path of the fluid flow, the combination of said cups and said opening means causing turbulence in the flow of the fluid and increasing contact of the fluid with the conduit for enhancing transfer of any heat in the fluid to the conduit, while minimizing impediment to the flow of the fluid.

2. A fluid turbulator as in claim 1 in which said louvered cups comprise material of said strip displaced from the plane of said strip and forming cuts in said strip which define both said opening means in the plane of said strip and said leading edges terminating each of said cups displaced from the plane of said strip.

3. A fluid turbulator as in claim 2 in which a pump is coupled to the conduit for flowing the fluid in the one direction, said cup terminating edges directing the fluid through said opening means and away from said strip, and thereby increasing the turbulence in the fluid flow.

4. A fluid turbulator as in claim 2 wherein adjacent ones of said cups extend alternately from both sides of said strip.

5. A fluid turbulator as in claim 4 wherein said cups extend towards the conduit without making contact therewith for permitting the fluid to flow between said cups and the conduit.

6. A fluid turbulator as in claim 2 wherein each of said cups comprise a generally flat portion parallel to the plane of said strip, and including said closed portion separate from said cuts securing said flat portion to said strip.

7. A fluid turbulator as in claim 6 wherein adjacent groups of said cups extend alternately from both sides of said strip.

8. A fluid turbulator as in claim 7 wherein said groups of said cups are positioned in parallel and in series along said strip.

* * * * *